US006259215B1

(12) United States Patent
Roman

(10) Patent No.: US 6,259,215 B1
(45) Date of Patent: Jul. 10, 2001

(54) ELECTRONIC HIGH INTENSITY DISCHARGE BALLAST

(75) Inventor: Daniel Roman, North York (CA)

(73) Assignee: Romlight International, Inc. (BB)

( * ) Notice: Subject to any disclaimer, the term of this patent is extended or adjusted under 35 U.S.C. 154(b) by 0 days.

(21) Appl. No.: 09/136,976

(22) Filed: Aug. 20, 1998

(51) Int. Cl.[7] ..... G05F 1/00

(52) U.S. Cl. ..... 315/307; 315/291; 315/224; 315/247; 315/DIG. 2; 315/DIG. 4; 315/DIG. 7

(58) Field of Search ..... 315/291–293, 315/297, 299, 307–309, 209 R, 224, DIG. 2, DIG. 4, DIG. 7, 94, 106, 247

(56) References Cited

U.S. PATENT DOCUMENTS

| | | | | |
|---|---|---|---|---|
| 4,170,747 | * | 10/1979 | Holmes | 315/307 |
| 4,277,728 | * | 7/1981 | Stevens | 315/307 |
| 4,373,146 | | 2/1983 | Bonazoli et al. | 315/209 R |
| 4,415,839 | * | 11/1983 | Lesea | 315/308 |
| 4,717,863 | | 1/1988 | Zeiler | 315/307 |
| 5,041,767 | | 8/1991 | Doroftei et al. | 315/292 |
| 5,192,897 | * | 3/1993 | Vossough et al. | 315/308 |
| 5,493,182 | | 2/1996 | Sowa et al. | 315/291 |
| 5,612,597 | | 3/1997 | Wood | 315/293 |
| 5,680,015 | | 10/1997 | Bernitz et al. | 315/291 |
| 5,691,605 | | 11/1997 | Xia et al. . | |
| 5,757,630 | * | 5/1998 | Lesea | 315/291 X |
| 6,020,689 | | 2/2000 | Gradzki et al. . | |
| 6,040,661 | | 3/2000 | Bogdan . | |
| 6,072,283 | * | 6/2000 | Hedrei et al. | 315/307 |

* cited by examiner

*Primary Examiner*—Haissa Philogene
(74) *Attorney, Agent, or Firm*—Stuart D. Rudoler; Wolf, Block, Schorr and Solis-Cohen LLP

(57) ABSTRACT

A microprocessor controlled high frequency electronic ballast for gas discharge lamps in which the dimming is accomplished by varying the frequency of the square wave generated by the ballast. Prior to ignition the ballast generates a high frequency square wave to preheat the lamp filament. The microprocessor, which is programmable, controls the operating and preheating frequencies of the ballast. The ballast demonstrates very few losses due to the efficiency gained by operating at high frequencies.

10 Claims, 9 Drawing Sheets

| | |
|---|---|
| FIG.2A | FIG.2B |
| FIG.2C | FIG.2D |

ELECTRONIC HIGH INTENSITY DISCHARGE BALLAST

DESCRIPTION

1. Field of Invention

This invention relates generally to an electronic ballast and in particular relates to an electronic high intensity discharge ballast.

2. Background Art

Ballasts are an integral part of many gas discharged systems such as fluorescent or high intensity density discharge (HID) lighting. Ballast's regulate the flow of electrical current to the lamp to maintain its operation.

Compact fluorescent is commonly used in office lighting as well as in homes. HID lighting systems on the other hand are lights used in large retail stores, industrial buildings, shopping malls and studios. HID lighting's most common use is for parking lots and street lighting. High intensity discharge systems can consist of metal halide lighting systems as well as high pressure sodium lighting systems (HPS).

Many compact fluorescent incorporate electromagnetic adaptors or ballast to power the lamp. Moreover, standard electromagnetic HID ballast operate with a basic core/coil transformer, a capacitor and in the case of high pressure sodium lighting systems an added igniter. These components simply start and maintain the lamp operating functions.

However, electromagnetic ballast's exhibit a number of disadvantages such as:

(a) not energy efficient;
(b) are susceptible to incoming voltage fluctuations;
(c) have an hard initial start up which degrade the life expectancy of the lamp;
(d) generally can not be dimmed;
(e) physically heavy making them difficult to instal in aerial situations;
(f) have many wires to interconnect which complicates their installation;
(g) noisy with age;
(h) operated at relatively high temperatures;
(i) can be damaged by power surges.

Various ballast and systems have heretofore been designed to overcome some of these disadvantages.

For example, U.S. Pat. No. 4,717,836 relates to an oscillator circuit which generates a frequency modulated square wave output signal to vary the frequency of the power supplied to a circuit.

Moreover, U.S. Pat. No. 5,493,182 relates to a dimmer operation of a fluorescent lamp.

Yet another arrangement is shown in U.S. Pat. No. 5,041,767 which relates to gas discharge system controlled in intensity and in the length along a tube that is illuminated by providing digital control signals to an analog drive circuit connected to the high voltage energization device for the tube.

Yet another arrangement is shown in U.S. Pat. No. 4,373,146 which relates to a method of operating a high intensity discharge lamp having a pair of electrodes hermetically sealed with an arc tube the method comprising frequency modulation of a carrier wave form in the kilohertz range to provide a variable frequency AC output and applying the AC output across the electrodes of the lamp to thereby operate the lamp in a manner which minimizes or avoids the acoustic resonance effect within the arced tube.

U.S. Pat. No. 5,680,015 relates to a low power, high pressure discharge lamp.

Finally, U.S. Pat. No. 5,612,597 relates to a circuit and method for driving a load such as a gas discharge illumination device from an AC main supply with a high power factor. The circuit includes a pair of electronic switches arranged in the half bridge configuration and self-oscillating driver circuit having two outputs for driving respective ones of the electronic switches, the electronic switches being coupled across an AC bus voltage and having a switched output coupled to the load.

SUMMARY OF THE INVENTION

It is an object of this invention to provide an improved electronic high intensity discharge ballast.

One aspect of this invention relates to a circuit for driving a gas discharge illumination device comprising; a microprocessor controlling circuitry to generate a square wave form having variable frequency for dimming said gas discharge illumination device.

It is another aspect of this invention relate to an electronic high intensity discharge ballast for an illumination devices comprising rectifying circuitry for rectifying an alternating current to a direct current; power factor correction circuitry for boosting the voltage to be supplied to said illumination device; a pair of MOSFET's for generating a square wave form with a frequency for powering said illumination device; microprocessor means for monitoring and controlling said power factor circuitry and said MOSFET's.

BRIEF DESCRIPTION OF DRAWINGS

These and other objects and features of the invention shall now be described in relation to the following drawings.

BEST MODE FOR CARRYING OUT THE INVENTION

Figure 1:
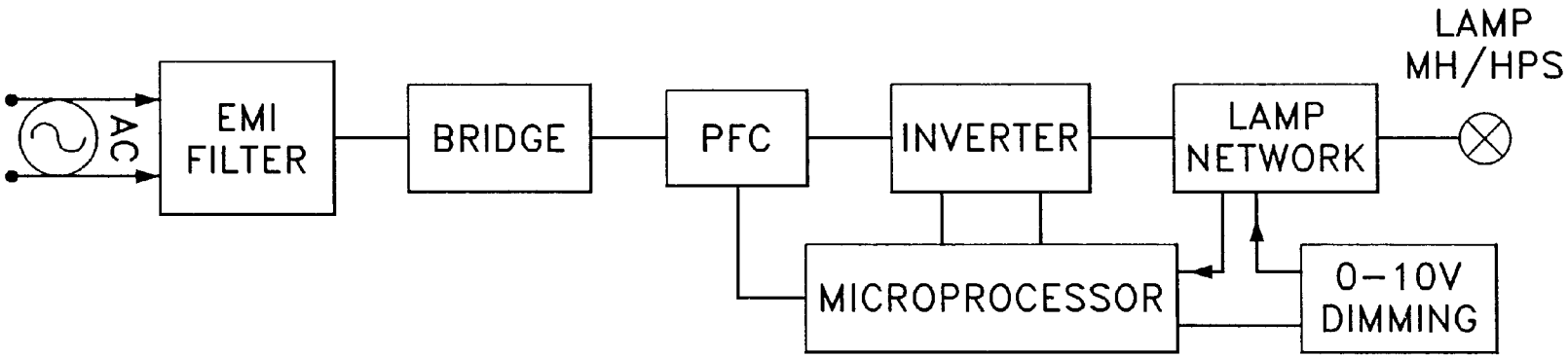
FIG. 1 is a high intensity discharge (HID) ballast block diagram.

In the description which follows, like parts are marked throughout the specification and the drawings with the same respective reference numerals. The drawings are not necessarily to scale and in some instances proportions may have been exaggerated in order to more clearly depict certain features of the invention.

Like parts will contain like numbers throughout the figures.

Figures 2, 2A:
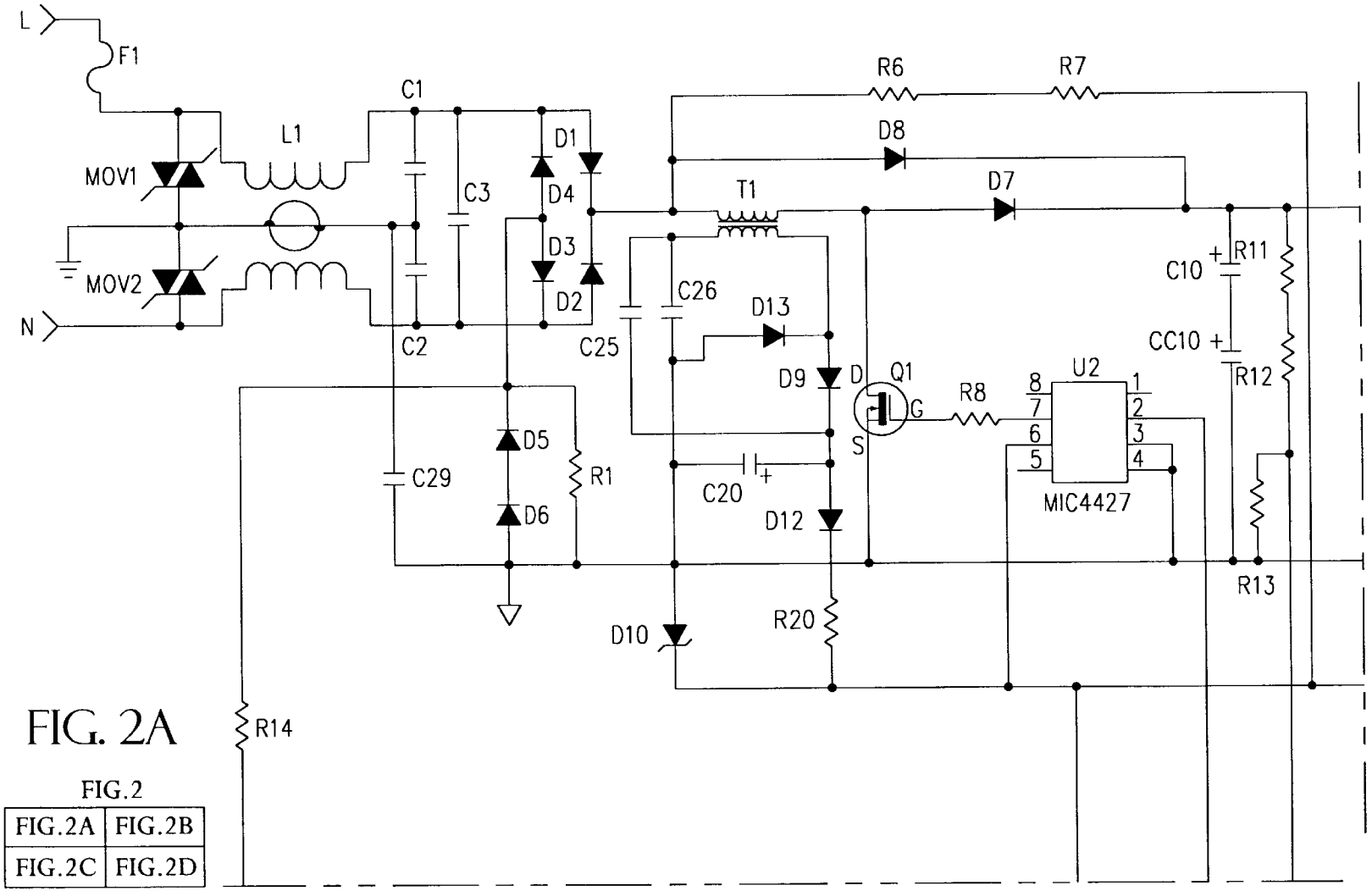
FIG. 2 is a schematic diagram of the HID ballast.
Figure 2B:
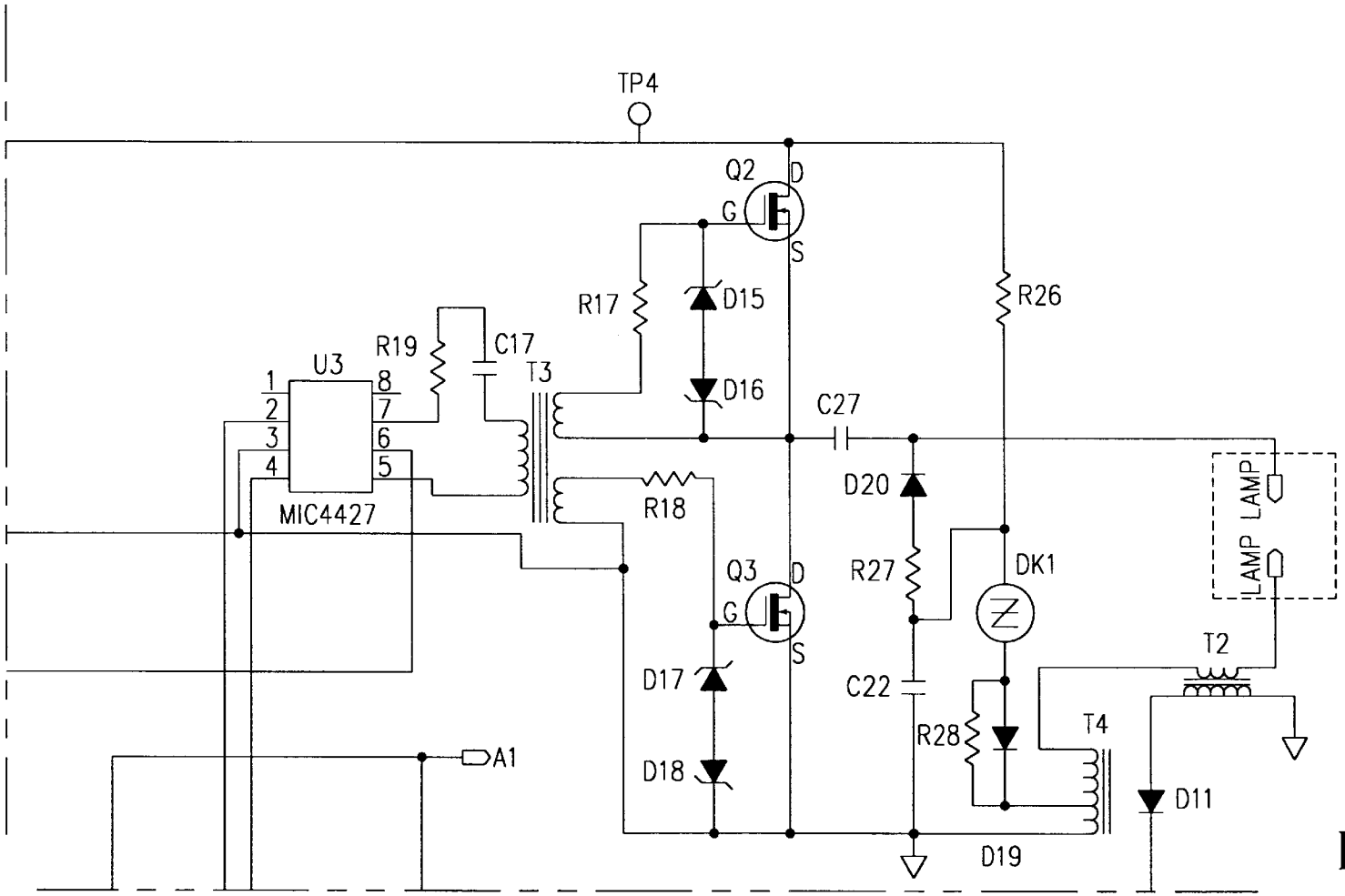
Figure 2C:
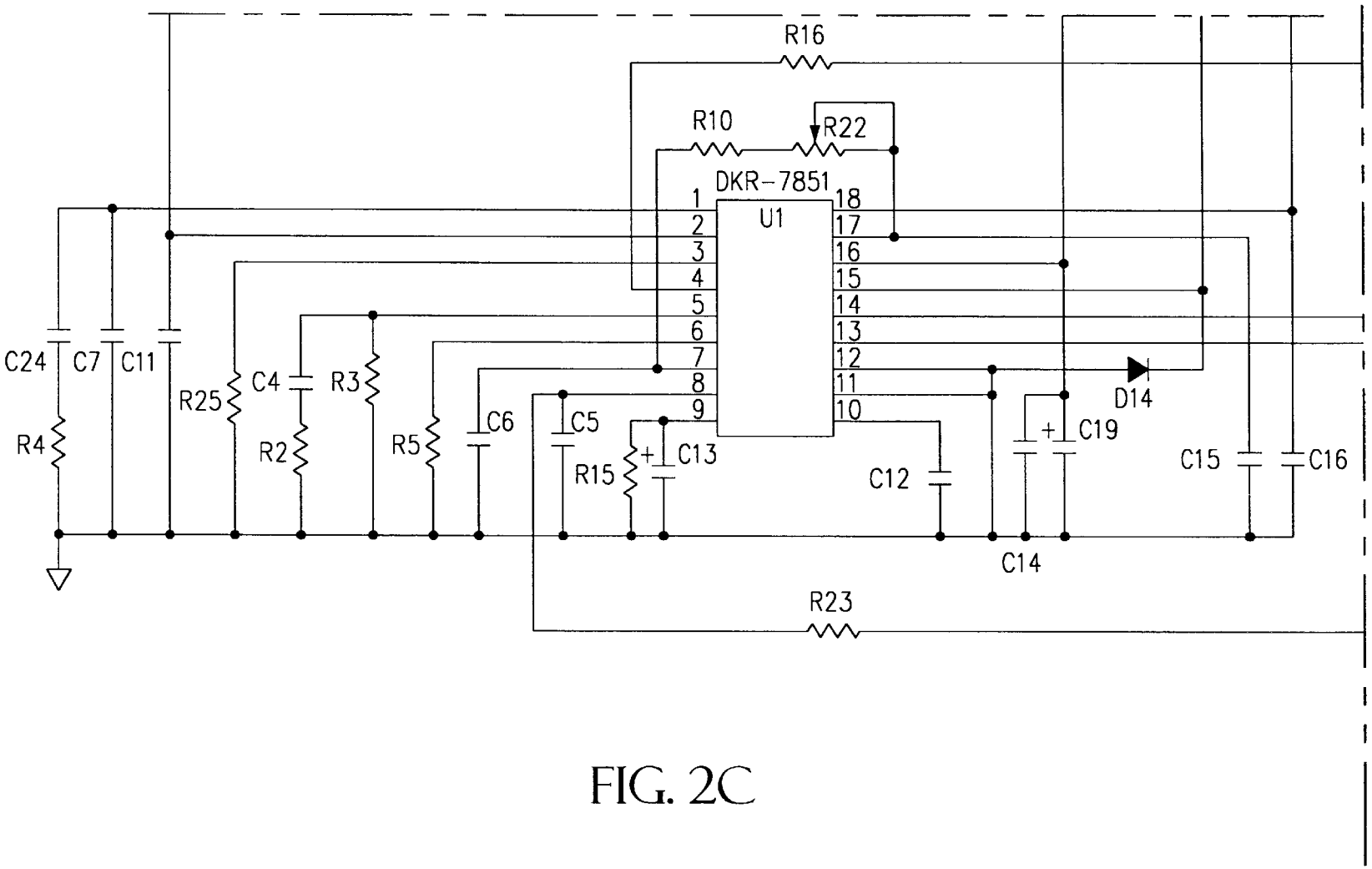
Figure 2D:
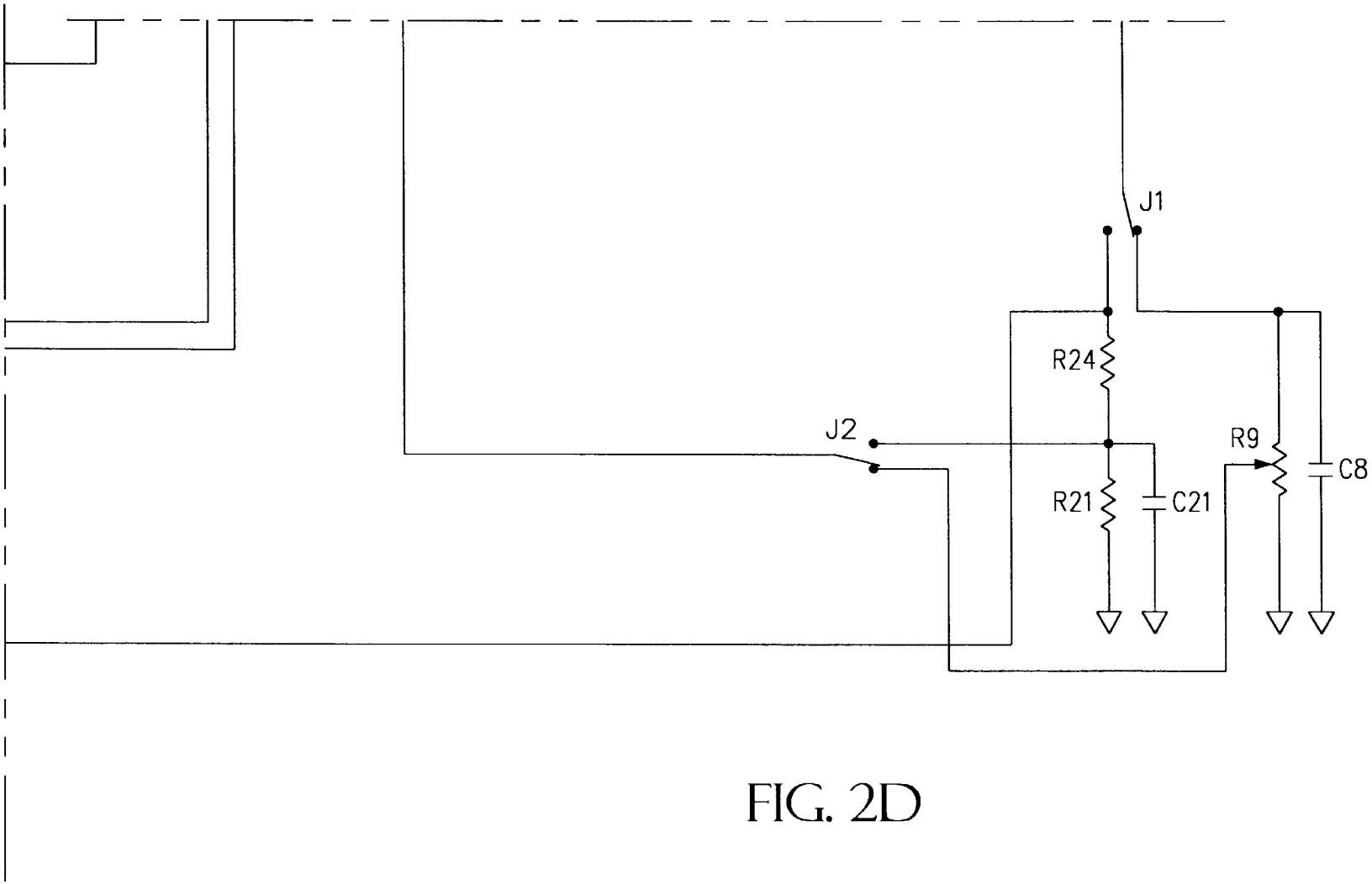

FIGS. 1 and 2 are a block diagram and a schematic view of the electronic ballast respectively.

As shown in FIGS. 1 and 2 the microprocessor U1 monitors a number of important functions, namely:

1. the incoming voltage which is controlled by a power factor correction circuit to be more fully described herein. The power factor correction circuit maintains constant lamp output voltage even if the incoming power source fluctuate anywhere between 80 volts to 600 volts.

2. Ambient temperature extremes. If the temperature is below 25° C., ballast has a warming circuit that gently heats its electronic components and then turns the ballast on only after the minimum operating temperatures have been achieved. If the temperature increases above 105° C., the microprocessor will automatically shut itself off to protect the ballast.

3. The dimming function.

The microprocessor U1 also monitors light output, current levels to the lamp, and internal circuit functions.

FIG. 1 identifies in block form the EMI filter, the bridge, the power factor correction circuitry, the inverter, the lamp network, the lamps, dimming control and the microprocessor.

EMI Filter

The filter L1 cuts noise and filters out harmonics for an incoming 220 volt alternating current of 50 to 60 hertz cycle. The circuitry is protected against spiking of the incoming current by means of MOV1 and MOV2 which protects against high charges.

Bridge

Diodes D1, D2, D3 and D4 are set up as a standard bridge to rectify the AC current to a DC current.

Power Factor Correction

Transformer T1, diode D7 and field effect transistor (FET) Q1 step up the voltage to 400 volts DC. A driver U2 is the driver for FET Q1. Driver U2 is connected at pin 2 to pins 15 and 12 of the microprocessor U1. Moreover, the secondary winding of the transformer T1 supplies power to the microprocessor U1 and the embodiment as shown in FIG. 1 comprises 15 volts.

FIG. 2 illustrates the Power Factor Correction (PFC) circuit whereby the start up power is supplied to the microprocessor U1 enabling gate drive for the PFC to boost the metal oxide semi-conductor field effect transistor (MOSFET) Q1 and inverter FET'S Q2 and Q3. The PFC generates a well-regulated 400 volt DC supply for the lamp inverter circuitry and steady low DC supply voltage to the microprocessor as described above. Transformer T1 creates an energy surge as described above.

The PFC circuit requires one loop for compensation; in particular the PFC circuit comprises a peak current sensing boost mode control circuit in which one voltage loop compensation is required.

Referring to FIG. 2 the PFC consists of a voltage error amplifier, a current sense amplifier (where no compensation is needed) and integrator, a comparator, and a logic control block. More particularly, in the boost topology, the power factor correction is achieved by sensing the output voltage and the current flowing through the current sensor resistor. Duty cycle control is achieved by comparing the integrated voltage signal of the error amplifier and the voltage across the sense resistor. Setting minimum input voltage for output regulation can be achieved by changing the algorithms in the software section for the microprocessor U1.

As stated above this system produces power factor in the vicinity of 0.99 low THD (total harmonic distortion).

Moreover, an over voltage comparator inhibits the PFC section in the event of a lamp out or lamp failure condition.

The pulse width modulation regulator in the PFC acts to offset the positive voltage caused by the multiplier output by producing an offset negative voltage on the current sensor resistor. A cycle by cycle current limit is included to protect MOSFET Q1 from high speed current transients.

The rectified line input sense wave is converted to a current on the reference to the pulse width modulated comparator. The output of the PFC multiplier is a voltage, which appears on the positive terminal of the amplifier to form the reference for the current error amplifier.

Figure 4:
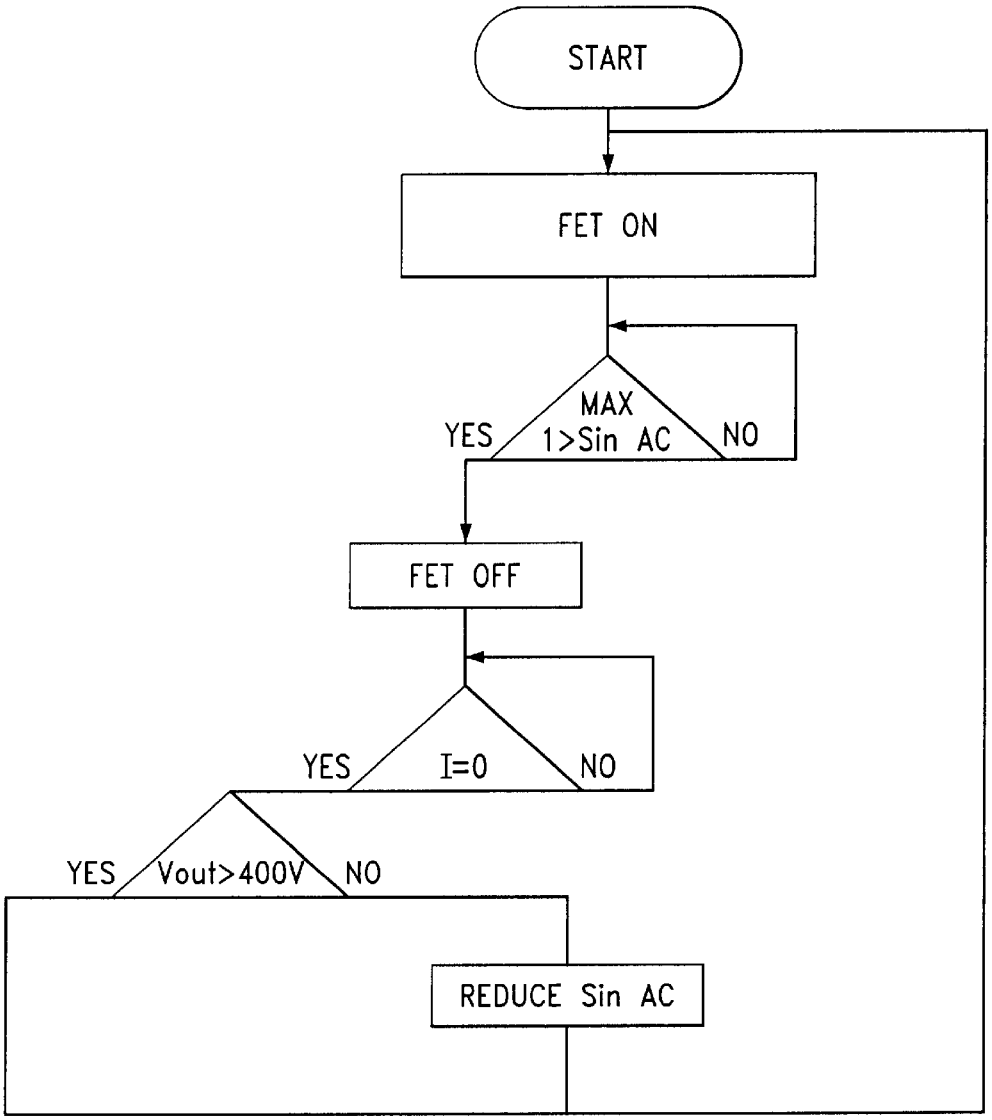
FIG. 4 is a logic diagram of the power factor correction user mode.

Moreover, FIG. 4 illustrates the logic diagram of the PFC user mode.

Inverter

The driver U3, drives MOSFET'S Q2 and Q3. The inverter stage consists of two totem pole configured N-channel power MOSFETs with their common node supplying the lamp network. The pair of MOSFETS are driven out of phase by the microprocessor U1 with a fifty percent duty cycle. The controller converts the standard 60 Hz line voltage into a 20 KHz to 100 KHz square wave form. This high frequency allows the lamp to be driven from an efficient resonant network, achieving a power factor rating of substantially approaching 1.00 by drawing current from the power line in phase with the voltage wave form on the line.

Accordingly, the microprocessor U1 monitors the incoming voltage which is controlled by the power factor correction circuit described above that maintains constant lamp output voltage even if the incoming power source fluctuate anywhere from 80 volts to 600 volts.

Lamp Network

The microcontroller U1 controls the lamps starting sequence. During the start up the microcontroller produces high frequency for filament preheat, but will not produce sufficient voltage to ignite the lamp or cause sufficient glow current. For example, by way of explanation but without restricting the generality of the invention described herein the embodiment shown in FIG. 2 shows a filament preheat and lamp out interrupt C22 is charged with a current of IR(SET)\4 and discharged through R27. In the example shown in FIG. 2, the voltage at C22 is initialized to 0.7V at power up. Time for C22 to rise to 3.4V is the filament preheat time. During that time, the oscillator charging current is 2.51IR(SET). This will produce a high frequency for filament preheat, but will not produce sufficient voltage to ignite the lamp.

After cathode heating, the inverted frequency drops causing a high voltage to appear and ignite the lamp.

If the lamp current is not detected when the lamp voltage was to have ignited, the lamp voltage feed back communicating with the microcontroller U1 is not detected and the circuitry will restrike excessively until the load is on. Shutting of the inverter in this manner minimizes the inverter from generating excessive heat when the lamp fails to strike or is out of socket. In other words, the voltage does not drop when the lamp was designed to have been ignited; rather the lamp voltage feed back communicating to the logic control of the microprocessor U1 rises to above a reference voltage and then C22 charging current is shut of and the inverter is inhibited until C22 is discharged by R27 to the 1.2 voltage threshold. The lamp feed back out command is ignored by the oscillator until C22 reaches 6.8 volts (for example) threshold in which case the lamp is therefore driven to full power and may be dimmed in a manner to be described herein. Once the lamp is driven to full power C22 is clamped to about 7.5V.

Accordingly a voltage of 3 to 5 kilovolts is required to fire up the lamp which is accomplished through transformer T4. Once the lamp is fired up DIAC DK1 disconnects such circuitry.

The combination of the transformer T2 and diode D11 steps down the voltage 100;1 which signals are then read by microprocessor U1.

Figure 3:
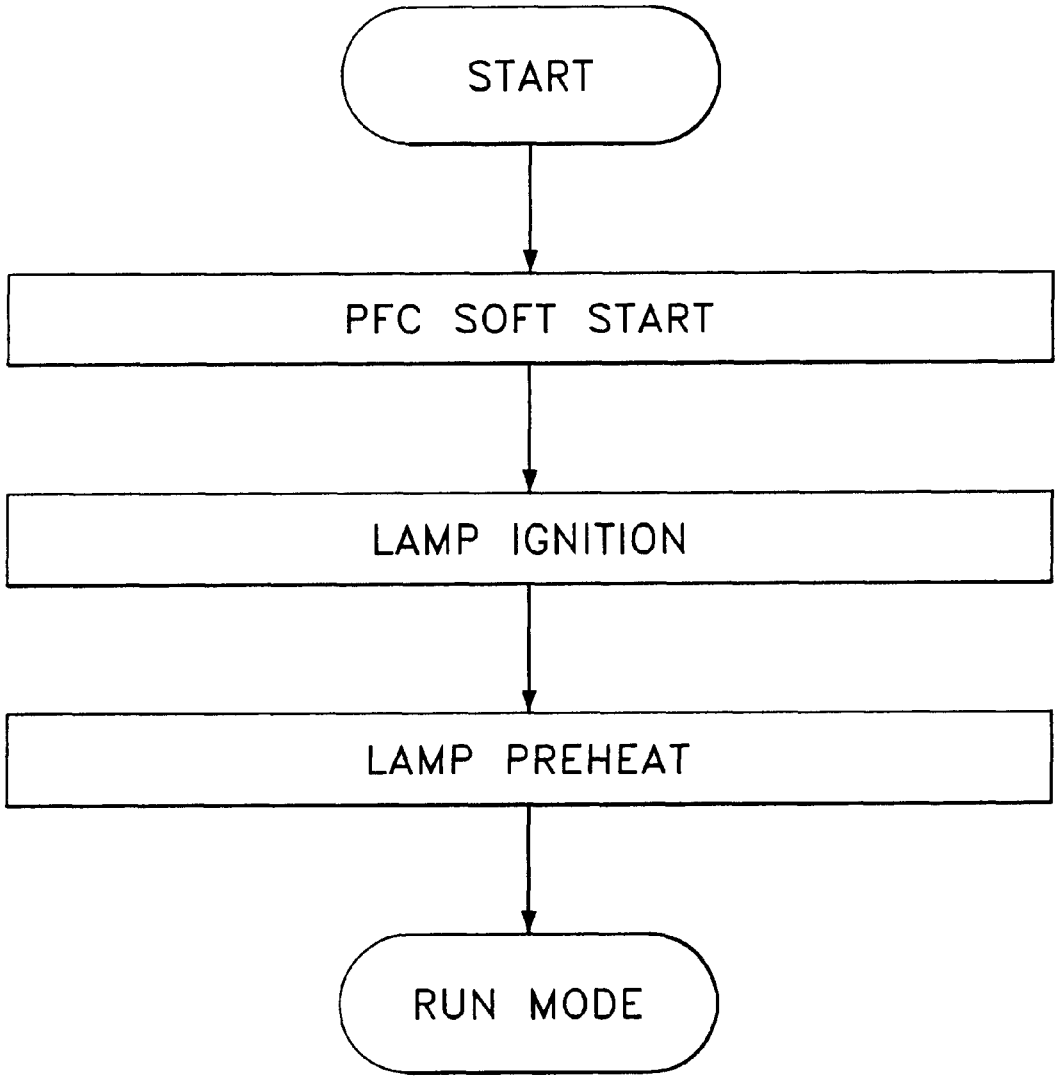
FIG. 3 is a logic diagram of the power up sequence.

The power up sequencing logic is shown in FIG. 3.

Dimming

The electronic high intensity discharge ballast described herein also includes a dimming feature. The dimming switch of FIG. 2 consists of a potentiometer R9 which is a switch that can be used to control the dimming. The dimming is accomplished by varying the frequency of the current to the lamp. The frequency ranges are controlled by the output of the lamp feed back amplifier. As the lamp current decreases the output of the oscillator rises in voltage due to a rise in the control signal causing the C(t) charging current to decrease causing the oscillator frequency to decrease. Since the ballast output network is dependent on the frequency, the power to the lamp is dependent on the frequency. In other words, decreasing the frequency will increase lamp power or light intensity. Highest lamp power and lowest output frequency is obtained when V out is at its maximum output voltage V(HO).

Sampling the lamp current with a current sensing transformer controls light output. The transformer secondary current is converted to a voltage and is fed back to the microprocessor feed back error amplifier. Analog to digital converter reads the voltage and compares it with the microcontroller algorithms to increase or decrease the frequency accordingly. The microprocessor's amplifier output voltage varies in accordance with the amount of lamp current required as set by potentiometer R9. The impedance of the lamp network results in lower lamp currents and light as the inverter stage frequency is increased. By increasing the frequency of the impedance characteristics of the lamp network the lamp current as well as the light level is lowered, while the voltage is still maintained at the desired level of for example 400V.

In other words, the light intensity may be increased by lowering the frequency generated by FET'S Q2 and Q3. The dimming range in one embodiment shown in FIG. 2 is capable of a 20; 1 intensity change as well as 5% of full light output.

Figure 5:
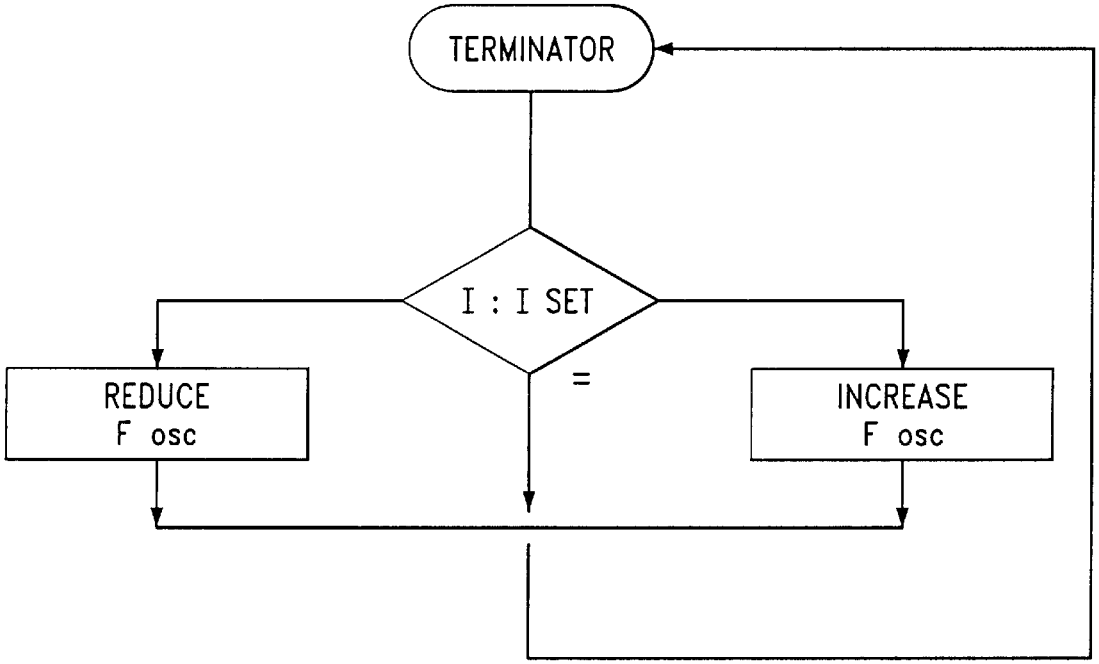
FIG. 5 is a logic diagram of the lamp run node.
Figure 6:
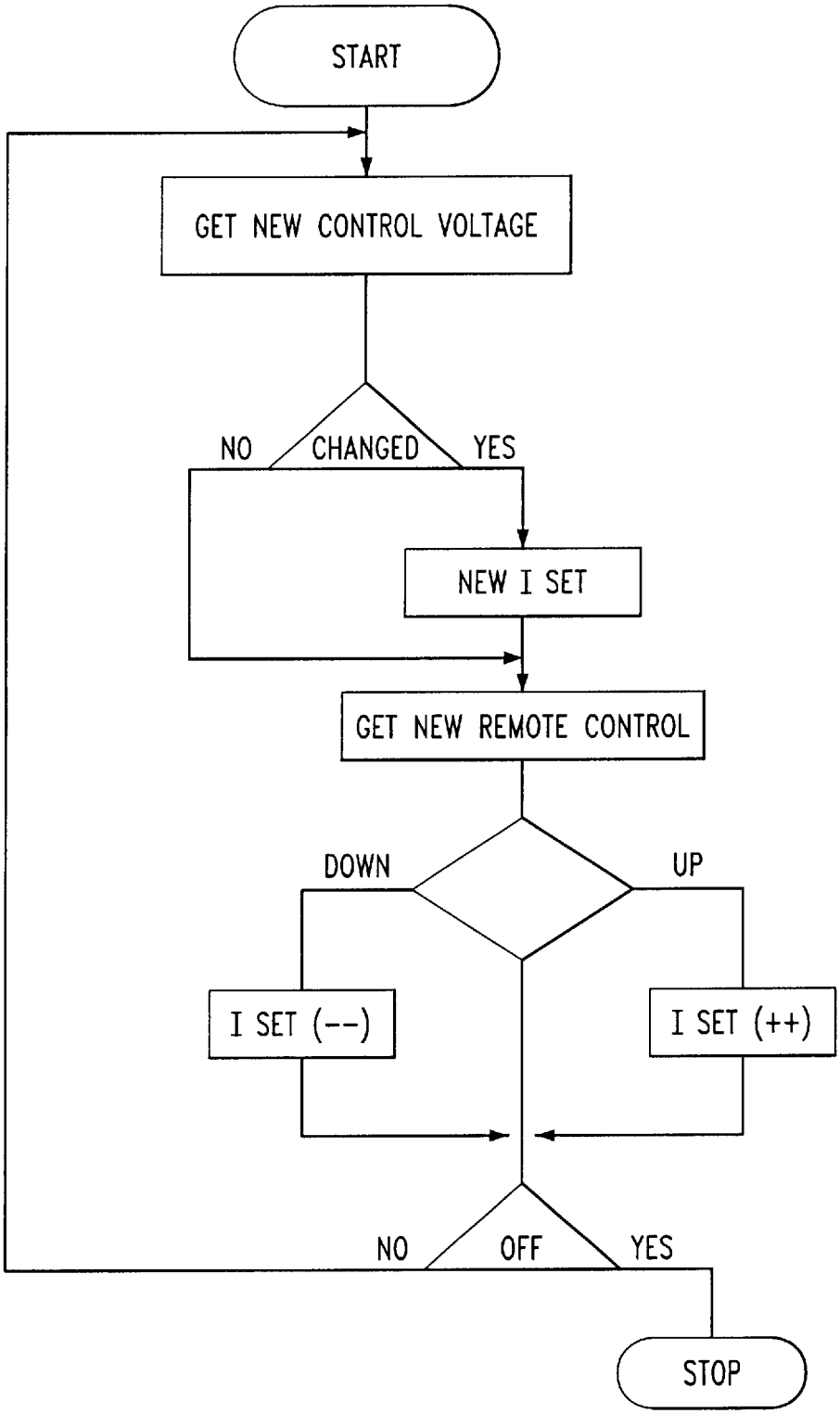
FIG. 6 is a logic diagram of the dimming control.

FIGS. 5 and 6 illustrate the lamp run mode and dimming control mode logic control respectively.

Resistor 22 can be set to adjust how quickly or slowly one can change the frequency.

The dimming capability referred to above have been described in relation a manual setting potentiometer R9. However, the dimming characteristics of the invention described herein can also be controlled by a number or of exterior devices such as photocells, occupancy sensors, computer controlled systems and infra red remote control.

For example, an electronic street lighting ballast manufactured in accordance with the invention described herein may be controlled by photocells or for that matter by satellite. A public utility will be able to dim its street lights in the evening when most roadways are not highly trafficked. For example, the street lights may be dimmed as much as 20% by a satellite at 2 a.m. A timed signal can be generated by a computer at the utilities headquarters and sent by modem to a communication centre. This signal may then be uplinked to an existing satellite system and retransmitted down to chosen street lights. The dimming can occur gradually over five minutes which is not generally perceptible to a human eye. Such system can provide the public utility with energy savings.

Apart from energy savings the electronic ballast can improve maintenance savings as well since less molecular breakdown occurs in the lamp when dimmed slightly for example by 12% thus increasing lamp life.

Temperature Fluctuations

The microprocessor U1 also monitors ambient temperature extremes. For example, the ballast described herein has a warming circuit that gently heats its electronic components when the microprocessor U1 reads a low temperature setting such as for example -25° C. The microprocessor U1 then turns the ballast on after the circuitry has been warmed and reaches a minimum operating temperature. If the temperature exceeds an extreme heat such as for example 105° C., the microprocessor U1 will automatically shut itself off to protect the ballast. Accordingly, when the ballast is used for outdoor use such as street lighting monitoring of the operating temperature will tend to enhance the life of the lamp.

Over Voltage Protection

The ballast described herein also protects the power circuit from being subjected to excessive voltages if the load should change suddenly when for example when removing lamps. If the voltage exceeds for example 2.75V the microprocessor U1 the power factor correction circuitry is inhibited.

Microprocessor

The microprocessor U1 controls the function of the ballast and as described herein monitors light output, current levels to the lamp, internal circuit functions, power factor correction, and temperature control.

The following pin numbers describe the function of the microprocessor, namely:

1. PFC error amplifier output and compensation.
2. Inductor current sensing.
3. Comparator threshold that switches the operating frequency to the preheat frequency.
4. Inverting input of the error amplifier used to sense and regulates lamp arc current and dimming.
5. Output of the lamp current transconductance amplifier used for lamp current loop compensation.
6. Compensation for the oscillator and current charging.
7. Oscillator timing.
8. Lamp-out detection, restart and programmable interval resetting.
9. Preheat timing, dimming lockout and interrupt.
10. Error amplifier out.
11. Power GND.
12. power GND.
13. MOSFET drive out.
14. MOSFET drive out.
15. PFC MOSFET drive out.
16. VCC.
17. Buffer output.
18. Inverting input to PFC error amplifier.

Electronic High Intensity Discharge Ballast

The electronic high intensity discharge ballast described herein controls and regulates the flow of electrical current to high intensity discharge lamp for metal halide or high pressure sodium lighting systems. As described herein the HID ballast does not consume energy in the form of a ballast load typically found in the case or core\coil electromagnetic ballast. Generally speaking all electromagnetic HID ballast consume a ballast load or power in addition to that of the lamp. For instance, with a 400 watt HPS lighting system will draw 400 watts for the lamp plus another 75 watts in ballast load for a total of 475 watts which has an efficiency 400\475 =84%.

It has been empericably determined that the electronic ballast described herein draws 391 watts to produce the same light as in the electromagnetic ballast at 475 and consuming approximately 20% energy. Furthermore the 391 watt electronic ballast and lamp is approximately 2% more efficient than the 400 watt lamp itself since the electronic ballast operates at a higher frequency and produces 5% more light. The end result is a system which is more efficient.

As described above the electronic ballast has the ability to dim to any light level desired and energy savings can be experienced as a nominal reduction in light of 20% is not generally perceptible by human eye.

Characteristics

The electronic HID ballast exhibits the following characteristics:

| | |
|---|---|
| MICROPROCESSOR | controls cold temperature and thermal protection lamp current, dimming circuit, power factor correction and harmonics |
| DIMMING CAPABILITIES | variable controls for photocell, motion sensor, computer interface, satellite signal. Brightness levels from 100% to 5% |
| POWER FACTOR CORRECTION | ballast generally accepts incoming voltage fluctuations from 140 volts to 500 volts while maintaining constant lamp current |
| POWER FACTOR | high power factor approaching 1.0 or greater than .995 |
| LOW HARMONICS | total harmonic distortion of less than 10% |
| LAMP CURRENT | high frequency squarewave 42kz to 100kz |
| MINIMUM STARTING TEMPERATURE | indoor ballast; −25° C., outdoor ballast −160° C. |
| SURGE PROTECTION | protects against incoming transient voltages, surges and spikes |
| WEIGHT | less than 3 pounds |
| DIMENSIONS | 6 inches × 6 inches × 4 inches |
| CONNECTIONS | three primary wires and two secondary wires. |

The system described above also exhibits the following characteristics:

a) resonant operation anti-operating frequency b) substantially zero phase impedance transformation c) linear gain reduction with increasing filament voltage as frequency increases d) generation of the required starting voltage for the lamps e) high input impediance with open load f) substantially linear power reduction to the lamp with increasing frequency.

Moreover the system also exhibits the following features of the microprocessor:

a) substantially complete power factor correction and dimming control b) substantially low distortion, high efficiency, continuous boost peak current sensing c) software programmable start scenario for rapid or instant start lamps d) lamp current feedback for dimming control e) variable frequency dimming and starting f) software programmable restart for lamp out conditions to reduce ballast heating g) internal over temperature shut down replaces external heat sensor i) PFC over voltage comparator substantially eliminates output runaway due to load removal j) low start up current less than 0.5 Ma.

It will be apparent to those skilled in the art that in light of the foregoing disclosure, many alterations and modifications are possible in the practise of this invention without departing from the spirit or scope thereof. Accordingly, the scope of the invention is to be construed in accordance with the substance defined in the following claims.

I claim:

1. An electronic high intensity discharge ballast for an illumination device comprising:

(a) rectifying circuitry for rectifying an alternating current to a direct current;

(b) power factor correction circuitry for boosting the voltage to be supplied to said illumination device;

(c) a pair of MOSFET's for generating a square wave for filament preheating and powering said illumination device;

(d) a programmable microprocessor for monitoring and controlling said power factor circuitry and said MOSFET's; and (e) dimming circuitry for controlling the amount of dimming by varying the operating frequency of the MOSFET's;

wherein the microprocessor controls the MOSFET's to generate a first high frequency square wave for filament preheating followed by a second high frequency square wave for powering said illumination device.

2. The electronic high intensity discharge ballast as claimed in claim 1 wherein said illumination device comprises a high intensity discharge lamp.

3. The electronic high intensity discharge ballast as claimed in claim 1 wherein the power factor correction of said power factor correction circuitry approaches unity.

4. The electronic high intensity discharge ballast as claimed in claim 1 wherein said MOSFET's are driven out of phase by said microprocessor with a fifty per cent duty cycle.

5. The electronic high intensity discharge ballast as claimed in claim 1 wherein said MOSFET's comprise two totem pole N-channel power MOSFET's with the common node of said MOSFET's supplying power to said illumination device.

6. The electronic high intensity discharge ballast as claimed in claim 1 wherein said dimming circuitry includes a potentiometer.

7. The electronic high intensity discharge ballast as claimed in claim 1 wherein said second frequency is further controlled by an exterior device for dimming.

8. The electronic high intensity discharge ballast as claimed in claim 7 wherein the exterior device is a photocell, occupancy sensor, computer controlled system, infrared red remote control or communication satellite.

9. The circuit as claimed in claim 5 wherein dimming is accomplished while maintaining a substantially constant voltage across the MOSFET's and while operating the MOSFET's at a substantially constant duty cycle.

10. The circuit as claimed in claim 5 wherein dimming is accomplished while operating the MOSFET's at a substantially constant duty cycle.

* * * * *